US005249749A

United States Patent [19]

Krebsbach

[11] Patent Number: 5,249,749

[45] Date of Patent: Oct. 5, 1993

[54] SELF-CLEANING GARBAGE DISPOSAL

[76] Inventor: Frederick E. Krebsbach, 6195 NW. 55th La., Tamarac, Fla. 33319

[21] Appl. No.: 905,918

[22] Filed: Jun. 29, 1992

[51] Int. Cl.[5] ..... B02C 23/40

[52] U.S. Cl. ..... 241/46.016; 241/46.013; 4/DIG. 4; 134/115 G

[58] Field of Search ..... 241/46.013–46.016; 4/DIG. 4, 629; 134/115 G

[56] References Cited

U.S. PATENT DOCUMENTS

| | | | |
|---|---|---|---|
| 2,044,563 | 6/1936 | Carter | 241/46.013 X |
| 2,166,786 | 7/1939 | Alexay | 241/46.013 X |
| 2,655,966 | 10/1953 | Russell | 241/46.013 X |
| 2,918,222 | 12/1959 | Shepherd | 241/46.013 |
| 3,122,151 | 2/1964 | Chambers | 134/115 G X |
| 4,183,470 | 1/1980 | Hovartos et al. | 241/4.013 |
| 4,935,991 | 6/1990 | Tourney | 4/629 X |

*Primary Examiner*—Mark Rosenbausm
*Assistant Examiner*—Frances Chin
*Attorney, Agent, or Firm*—Malin, Haley, DiMaggio & Crosby

[57] ABSTRACT

A self-cleaning garbage disposal utilizes a spray ring which is located below the splash guard. A control valve is connected to the cold water pipe and controls the flow of water from the cold water line into the spray ring. The control valve is engaged simultaneously with the disposal when the disposal is activated, which also initiates a timer control circuit on the control valve. The spray ring, using standard water pressure, forces the food debris directly into the disposal blades in a counterclockwise direction for faster and more efficient grinding of the food debris. When the disposal is switched off, water continues to flow through the spray ring for approximately fifteen seconds, thoroughly flushing any remaining debris down the drain.

9 Claims, 5 Drawing Sheets

SELF-CLEANING GARBAGE DISPOSAL

BACKGROUND OF THE INVENTION

1. Field of the Invention

This invention relates generally to food waste disposers and in particular, to a more effective garbage disposal which is self-cleaning.

2. Description of the Prior Art

Food waste disposers of various types and kinds have been known in the art. Typically, such disposers are mounted to a sink by any convenient mounting means. These disposer units generally include a conically shaped hollow throat which is connected at one end to a grinder having a set of grinder blades. The blades of the grinder are driven by a motor. The grinder has an outlet that is connected to a drainpipe for receiving ground up waste products. In this manner, the ground up waste products may be washed down into the drainpipe by water flowing under the force of gravity. Many garbage disposal units also include a splash guard screen which tends to reduce the risk of discharge out of the drain. A number of garbage disposals are known in the art, including:

U.S. Pat. No. 4,935,991 issued to Tourney, which discloses a new and improved fish cleaning station which includes a centrally located garbage disposal unit. The garbage disposal unit has water inlets above the splash guard so that whenever power is applied to activate the disposal unit, a source of water will be automatically provided into the sink basin.

U.S. Pat. No. 2,753,571 issued to Draper, which discloses a garbage disposal unit having means for recovering tableware.

U.S. Pat. No. 4,135,258 issued to Brags, et al., which discloses a mounting apparatus for installing a food waste disposer in a sink wherein an improved clamp ring and locking ring structure are provided for effecting the clamping of the disposer to the sink opening edge.

A major disadvantage of the garbage disposals of the prior art is that oftentimes the operator shuts off the disposal simultaneous to or immediately after turning off the water, thereby allowing shredded debris to remain in the disposal. This causes undesirable odors and potential clogging which could require the use of drain cleaning chemicals which are harmful to the environment.

Another disadvantage of prior art disposal operation is that they rely on water flowing down into the drain through the splash guard. This process virtually eliminates all water pressure. With more water pressure striking the disposal blades, the blades would work more efficiently and reduce the debris more effectively and in a shorter period of time.

The instant invention addresses the aforementioned problems by providing a self-cleaning garbage disposal having a unique spray ring or water channel which is located below the splash guard. The spray ring, using standard water pressure, forces the food debris directly into the disposal blades in a counterclockwise direction to the disposal blades' rotation for faster and more efficient grinding of food debris. When the disposal is switched off, water continues to flow through the spray ring for approximately fifteen seconds, thoroughly flushing any remaining debris down the drain.

SUMMARY OF THE INVENTION

Therefore, it is the principal object of the present invention to provide a safer and more effective garbage disposal which is self-cleaning.

Another object of the current invention is to provide a more effective garbage disposal which is self-cleaning wherein the garbage disposal utilizes a spray ring which is located below the splash guard, thereby increasing the water pressure striking the disposal blades, causing the disposal blades to work more efficiently.

Another object of the current invention is to provide a more effective garbage disposal which is self-cleaning, wherein water continues to flow through the spray ring for approximately fifteen seconds after the disposal is switched off, thoroughly flushing any remaining debris through the blade encasement and down the drain.

In accordance with these and other objects which will be apparent hereinafter, the instant invention will now become described with particular reference to the accompanying drawings.

BRIEF DESCRIPTION OF THE DRAWINGS

The foregoing objects and advantages of the present invention, together with various other objects and advantages thereof, which will become apparent, may be attained with the exemplary embodiments of the invention which is illustrated in the accompanying drawings and described in detail hereinafter. Referring to the drawings.

DESCRIPTION OF THE PREFERRED EMBODIMENTS

Figure 1:
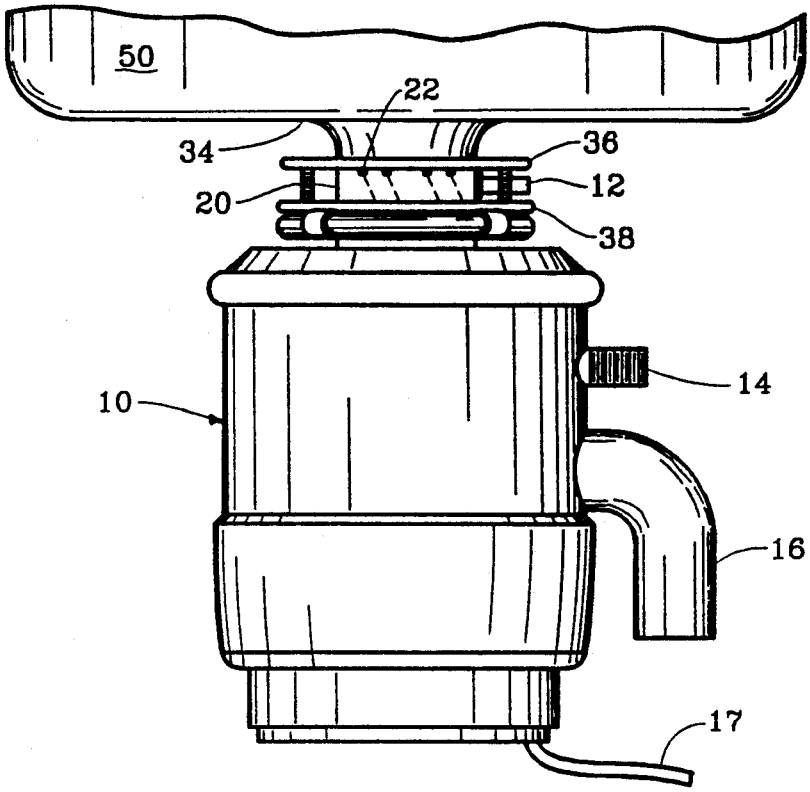
FIG. 1 is a perspective view of a self-cleaning garbage disposal which embodies the invention.

Referring now to the drawings, and more particularly to FIG. 1 thereof, there is shown a self-cleaning garbage disposal 10 which is constructed in accordance with the present invention. The garbage disposal 10 is installed in a kitchen sink 50 by mounting means generally consisting of a sink flange 34, a flange backup ring 36 and a flange mounting ring 38. The garbage disposal 10 also has a water inlet means 12 connected to a water source, the water inlet means 12 also being connected to a channel means 20 which is installed in sink flange 34, a dishwasher drain hose connection 14, a sewage drain hose connection 16, and a switch plug 17 for electrical connection of the garbage disposal to a control unit 40 shown in FIG. 7 of the drawings.

Figure 2:
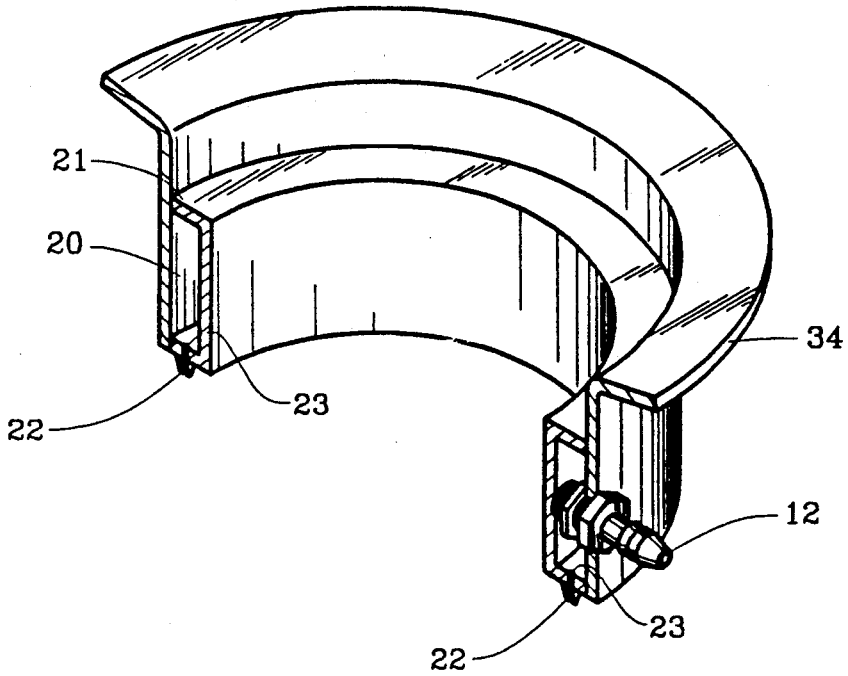
FIG. 2 is an isometric view illustrating the spray ring.
Figure 8:
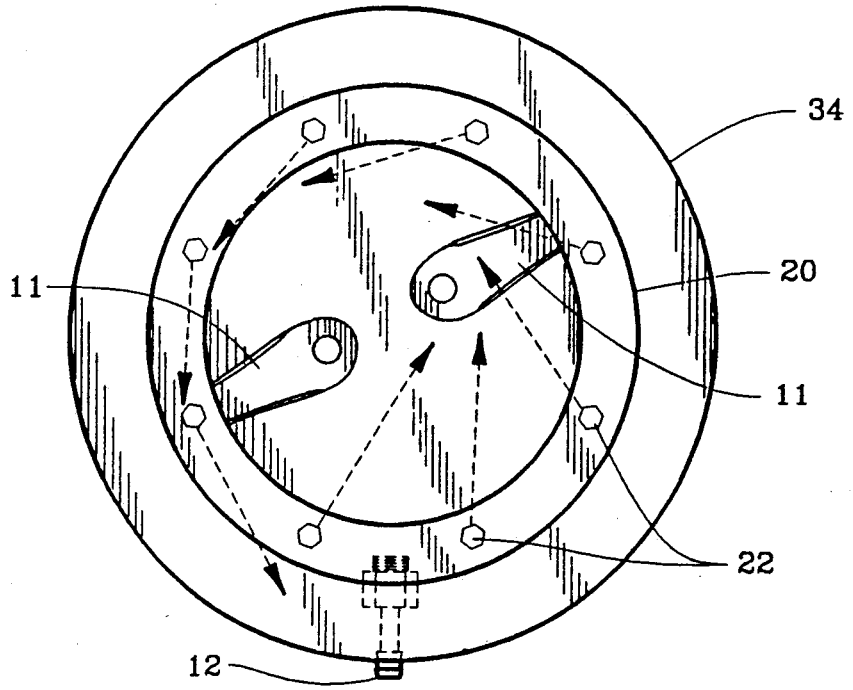
FIG. 8 is top view of the spray ring illustrating the flow of water through the spray nozzles.

The self-cleaning mechanism of the garbage disposal 10 is best shown in FIG. 2 of the drawings. The garbage disposal 10 utilizes channel means 20 installed in sink flange 34 with spray means 22 attached thereto. Water flows from the water source through water inlet 12 into the channel means 20. In a specific embodiment, channel means 20 can be a spray ring incorporated into a cylindrical collar 21. Jet orifices 23 are mounted within the bottom of collar 21. Channel means 20 serves as a guide for the water flowing into disposal 10 through water inlet 12. Water is then injected from channel means 20 into the blades of the disposal 10 through spray means 22. As best shown in FIG. 8 of the drawings, spray means 22 are aimed downwardly towards the blades 11 of the disposal 10 in a geometrically progressive pattern so that water being discharged into the blades of the disposal 10 through spray means 22 enters at approximately a 45° angle counterclockwise to the blade rotation of the disposal 10.

Figure 3:
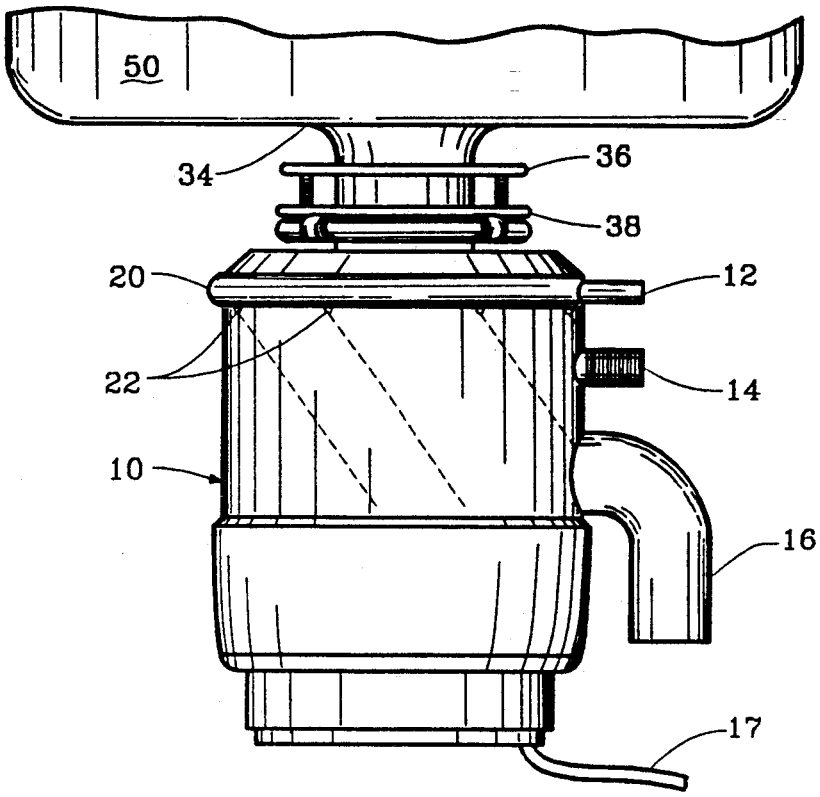
FIG. 3 is a view in perspective of an alternate embodiment of a self-cleaning garbage disposal according to the invention.

As best illustrated in FIG. 3 of the drawings, the channel means 20 may be incorporated into the garbage disposal 10 to form an integrated unit rather than the separately attachable unit illustrated in FIG. 1, wherein the channel means 20 is incorporated into the disposal 10 below body flange 42 shown in FIG. 5 of the drawings.

Figure 6:
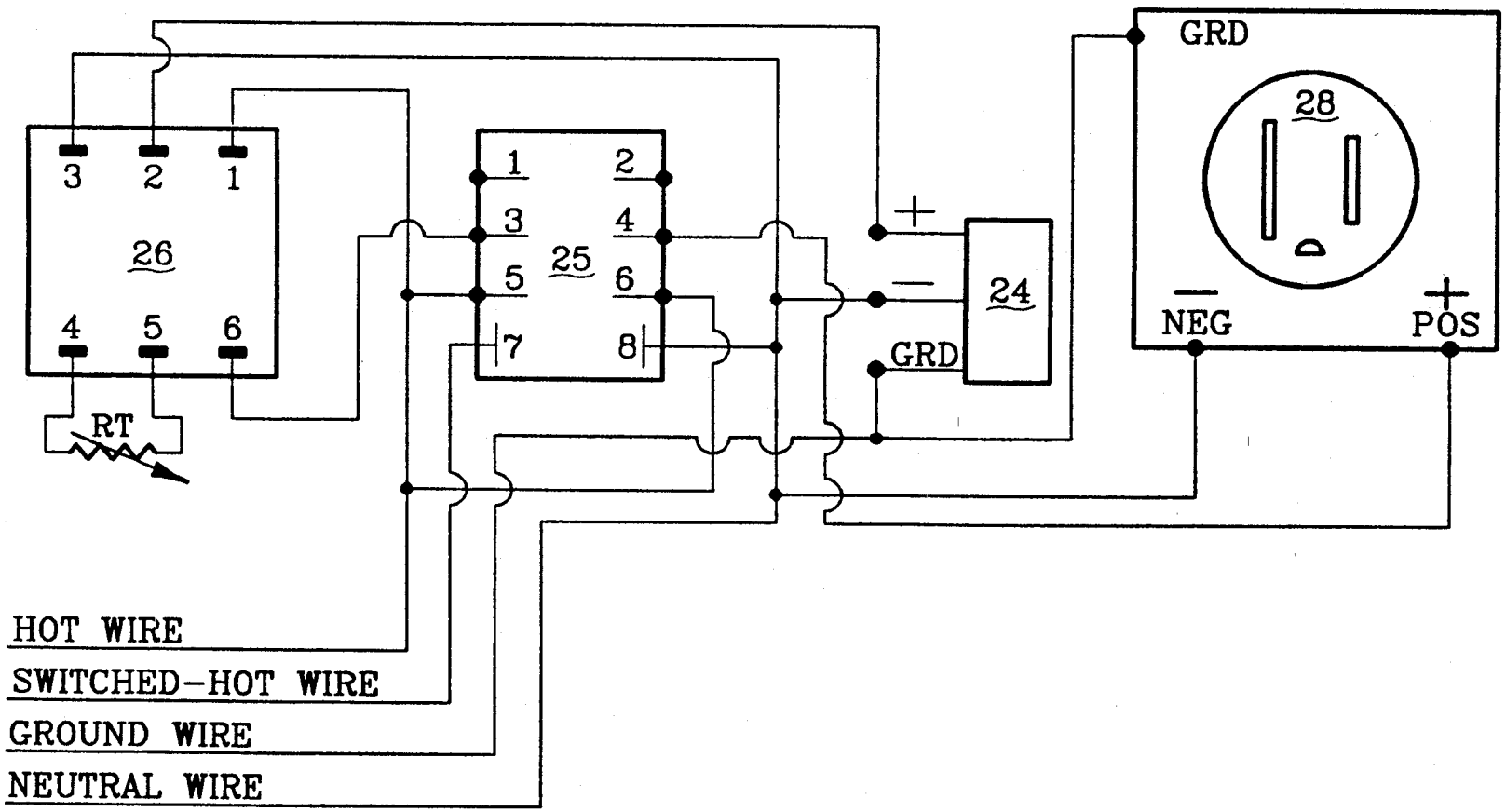
FIG. 6 is a circuit diagram of the control unit.
Figure 7:
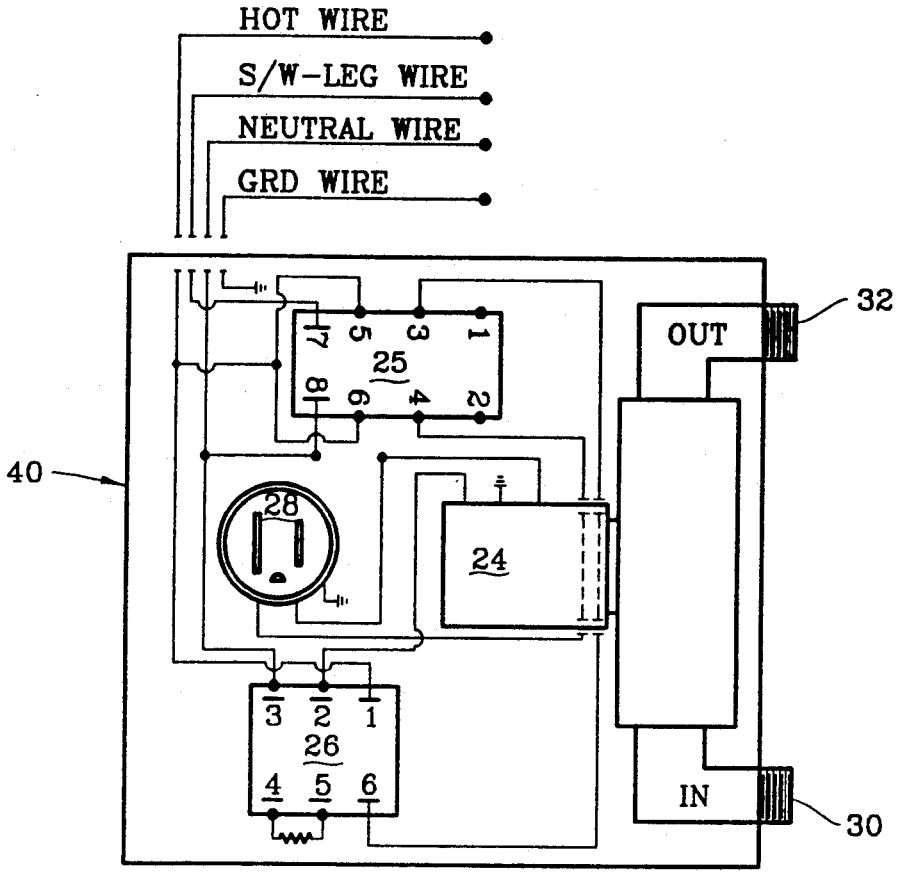
FIG. 7 is a block diagram of the control unit.

Connected to water inlet 12 is a control unit 40 which is connected to the cold water pipe and controls the flow of water from the cold water line into channel means 20. Control unit 40 is best illustrated in FIG. 7 of the drawings. The control unit 40 is provided with a cold water tap connection 30 which is connected directly to the cold water pipe, a water outlet connection 32 which is attached to water inlet means 12, a relay 25, a solenoid valve 24, a timer 26, and receptacle 28. The operation of the control unit 40 is as follows: The garbage disposal's 10 switch plug 17 is connected to receptacle 28. Receptacle 28 may be a standard two pole three wire grounding receptacle. The control unit 40 is engaged simultaneously with the disposal 10 when the disposal 10 is activated by means of relay 25, which also initiates timer 26. Water flows from the water source into control unit 40 through cold water tap connection 30, through solenoid valve 24, and out through water outlet connection 32. Water outlet connection 32 is connected to water inlet 12 of channel means 20, thus allowing water to flow into disposal 10. When the disposal 10 is deactivated, timer 26 is initiated, allowing water to continue to flow through channel means 20 and into the disposal 10 for approximately fifteen seconds after the disposal 10 is switched off. Upon completion of the delay period, the control unit 40 shuts the water off automatically. The activation and deactivation of the delay period is best illustrated by referring to the circuit diagram of control unit 40 in FIG. 6 of the drawings. Upon closure of the initiate switch (activation of disposal 10) the load is energized and will remain in this condition if no further action is taken. On opening of the initiate switch (deactivation of disposal 10) the time delay is started. On completion of the delay period, the load is de-energized. Should the switch be reclosed during timing, the delay will be reset to zero.

It is recognized by those of ordinary skill in the art that any number of circuit modifications can be incorporated into the instant invention to achieve these functions.

Figure 5:
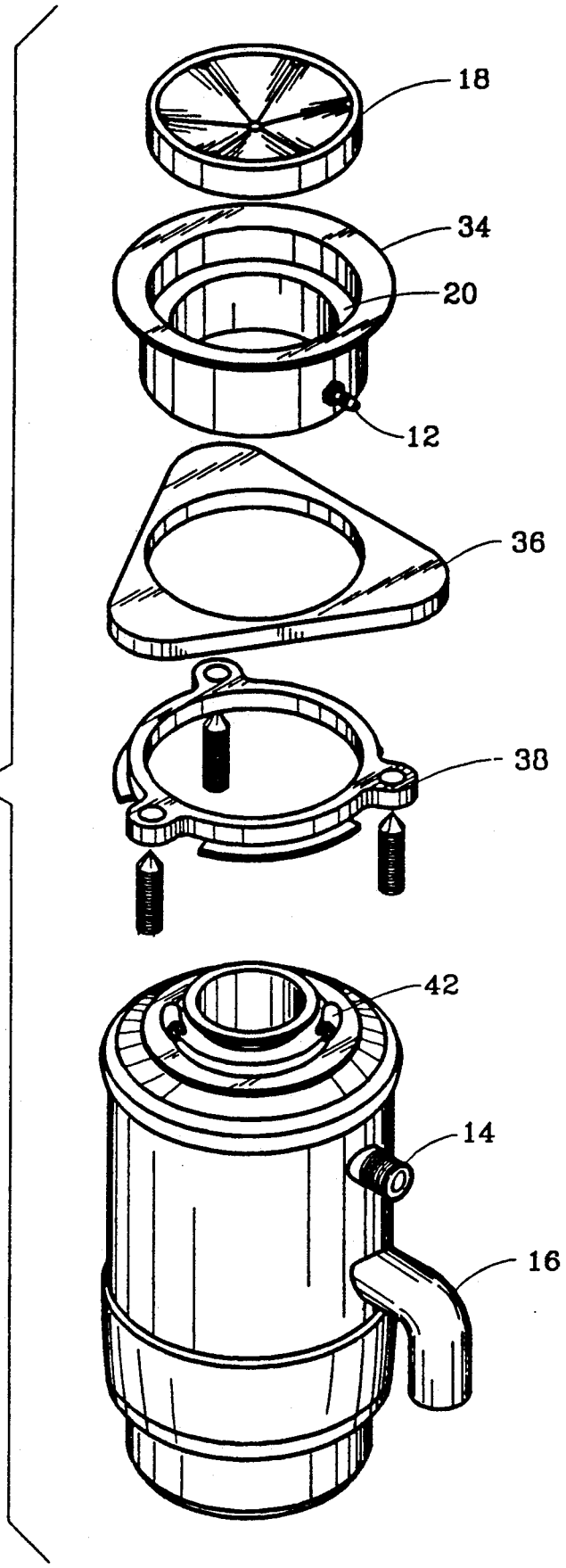
FIG. 5 is a perspective exploded view of a self-cleaning garbage disposal in accordance with the invention.

As best shown in FIG. 5 of the drawings, water flows directly into the disposal 10 through water inlet 12 at an entry point above the disposal blades but below rubber splash guard 18.

Figure 4:
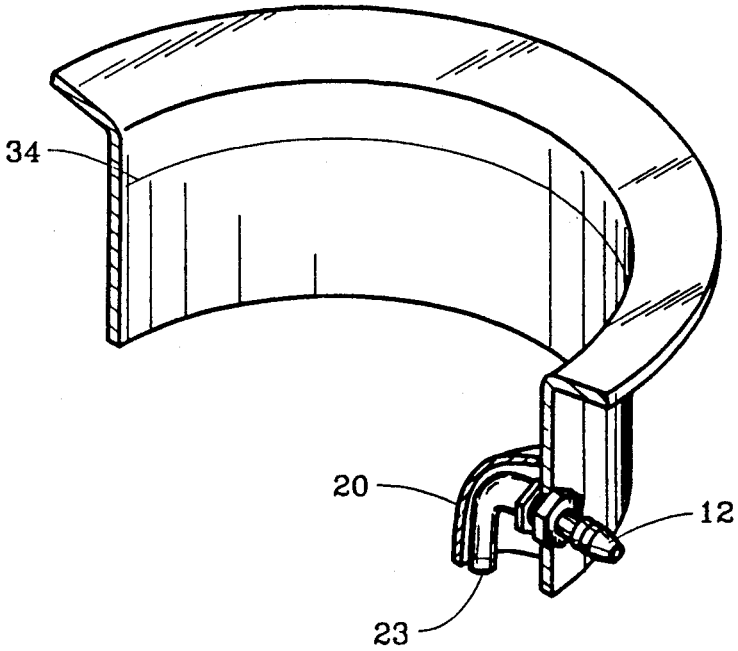
FIG. 4 is an isometric view illustrating an alternate embodiment of the spray ring showing a single spray jet.
Figure 4A:
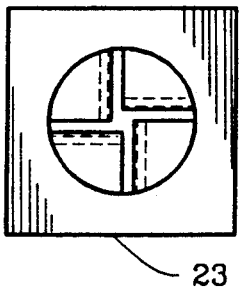
FIG. 4A is a bottom view illustrating the jet orifice of the alternate embodiment.

FIG. 4 and 4A is an alternate embodiment of the spray ring 20 in which a single spray jet orifice 23 is shown, wherein the water is not circulated completely around channel means 20, but is rather aimed at the entire bottom of the disposal in the form of a single jet.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. In a garbage disposal connected to to a sink, a dishwasher drain, a water source, an electrical power source, garbage disposal blades and a sewage drain, said garbage disposal having self-cleaning means, the improvement comprising said self-cleaning means including:

water inlet means connected to said water source for allowing water to flow into said garbage disposal, said water inlet means further being connected to control means, said control means controlling the flow of water from said water source into said garbage disposal;

channel means for directing the flow of water out of said water inlet means, said channel means being substantially circular; and spray means, connected to said channel means, and surrounding the outer rim of said disposal, for injecting water from said channel means into said garbage disposal, said spray means comprising a plurality of jet orifices attached about said channel.

2. The garbage disposal of claim 1 wherein said control means is engaged simultaneously with said garbage disposal when said garbage disposal is activated.

3. The garbage disposal of claim 1 wherein said control means further comprises a timing means, said timing means allowing the flow of water from said water source to continue to flow through said channel means for a predetermined period of time after said garbage disposal is deactivated, thereby allowing any remaining debris to be flushed down said sewage drain.

4. The garbage disposal of claim 1 wherein said control means shuts the flow of water from said water source off automatically after said predetermined period of time has expired.

5. The garbage disposal of claim 1 wherein said garbage disposal includes a splash guard, said splash guard helping to prevent products from being discharged upwardly through a sink drain opening.

6. The garbage disposal of claim 1 wherein said water inlet means enters said garbage disposal at a point above the garbage disposal blades, but below said splash guard.

7. The garbage disposal of claim 1, wherein said spray means are aligned such that the water flowing through said spray means is injected into said garbage disposal's blades counter rotational to said garbage disposal blades.

8. In a garbage disposal connected to a sink, a dishwasher drain, a water source, an electrical power source, garbage disposal blades and a sewage drain, said garbage disposal having self-cleaning means, the improvement comprising said self-cleaning means including:

water inlet means connected to said water source for allowing water to flow into said garbage disposal, said water inlet means further being connected to control means, said control means controlling the flow of water from said water source into said garbage disposal;

a generally cylindrical collar which surrounds the outer rim of said disposal, said cylindrical collar directing the flow of water out of said water inlet means; and a plurality of jet orifices disposed about the bottom of said cylindrical collar, said jet orifices injecting water from said cylindrical collar into said garbage disposal.

9. The garbage disposal of claim 8 wherein said jet orifices are aligned such that water flowing through said orifices is injected down into said garbage disposal's blades counterclockwise to said garbage disposal blades' rotation.

* * * * *